US005895601A

United States Patent [19]

Kim

[11] Patent Number: 5,895,601

[45] Date of Patent: Apr. 20, 1999

[54] DOOR LOCK MECHANISM WITH A DUCT FOR A MICROWAVE OVEN

[75] Inventor: Sang-Jin Kim, Incheon, Rep. of Korea

[73] Assignee: Daewoo Electronics Co., Ltd., Rep. of Korea

[21] Appl. No.: 08/825,383

[22] Filed: Mar. 28, 1997

[30] Foreign Application Priority Data

Mar. 29, 1996 [KR] Rep. of Korea ..... 1996-6472

[51] Int. Cl.[6] ..... H05B 6/76

[52] U.S. Cl. ..... 219/724; 219/757; 126/197

[58] Field of Search ..... 219/722, 723, 219/724, 757; 126/197, 198

[56] References Cited

U.S. PATENT DOCUMENTS

| | | | |
|---|---|---|---|
| 3,865,097 | 2/1975 | Robinson | 126/197 |
| 4,321,445 | 3/1982 | Kristof et al. | 219/724 |
| 4,504,719 | 3/1985 | Taylor, Jr. et al. | 219/724 |
| 4,638,136 | 1/1987 | Oya | 219/724 |
| 4,749,835 | 6/1988 | Fukumoto | 219/724 |
| 4,755,647 | 7/1988 | Nishikawa et al. | 219/724 |
| 4,982,063 | 1/1991 | Tsunekawa et al. | 219/723 |

*Primary Examiner*—Philip H. Leung
*Attorney, Agent, or Firm*—Pillsbury Madison & Sutro, LLP

[57] ABSTRACT

A door lock mechanism with a duct is disclosed, which has a duct section, a first lock part, a link bar part, a link bar part guiding part, a second lock part and an engagement part. The link bar part is formed in a rectangular bar shape and has a plurality of engagement grooves. One end of the link bar part is fixedly connected to the other end of the first lock part. The link bar part guiding part is formed in a rectangular bar shape of which center portion is hollow to form an insertion groove. The upper portion of one side of the link bar part guiding part has an engagement hole, and the link bar part guiding part is long enough for the link bar part to be fully inserted thereinto. The link bar part is inserted from the other end of the link bar part guiding part and each of the plurality of engagement grooves become correspondent to the engagement hole in turn when the link bar part is inserted into the insertion groove of the link bar part guiding part.

3 Claims, 4 Drawing Sheets

DOOR LOCK MECHANISM WITH A DUCT FOR A MICROWAVE OVEN

BACKGROUND OF THE INVENTION

1. Field of the Invention

The present invention relates to a microwave oven, and more particularly to a door lock mechanism with a duct for a microwave oven for providing an air passageway and performing mechanical operations such as engagement of the microwave oven door and electrical operations such as electrical switching.

2. Prior Art

In general, microwave ovens are classified into a microwave oven with a single function and a microwave oven with multiple functions, each having a cooking cavity and an electronic component compartment surrounded by a housing. The electronic component compartment has a magnetron therein from which the electromagnetic wave energy is generated and controlled for the cooking process. The single function microwave oven cooks food by energy of microwaves generated from the magnetron. The multiple functions microoven cooks food by the energy of microwaves and heat of a heater mounted in the electronic component compartment.

One side of the housing of the microwave is provided with intake/outlet holes for intaking and outletting air. Further, a duct is mounted inside the housing. The duct provides a passageway for guiding air inside the housing. The duct is, in general, mounted just beside the magnetron. A blower fan is mounted behind the magnetron. The blower fan cools heating components such as the magnetron. At this time, air which cools the heating components flows into the cooking cavity along the passageway of the duct.

In the meantime, one edge of the door of a microwave oven is hinged on the microwave oven, rotatably fixing to the microwave to thereby open and close the cooking cavity of the microwave. Door hooks are protruded from the other edge of the door. The door hooks enable the door to remain closed through engagement with a microwave oven component when the door is closed. The front panel is provided with a door hook release button. When the door is closed, pressing the door hook release button causes the door to be opened.

A door lock mechanism with a duct, which is used for the microwave oven, has a duct for providing a passageway to guide air and for performing certain mechanical and electrical operations according to engagement of the door with the door hooks as well as to pressing/releasing the door hook release button. Detailed descriptions of the structure and interrelationship of the components of the microwave oven are omitted since they can be easily understood in view of a general microwave oven.

FIG. 1 is a view for showing a conventional door lock mechanism with a duct for a microwave oven. As shown in FIG. 1, the conventional door lock mechanism with a duct 10 has a lock section 12 and a duct section 14. The lock section 12 performs mechanical operations such as its engagement with the door hooks and electrical operations such as electrical switching in association with the door hooks and the door hook release button. The duct section 14 provides an air passageway for guiding air inside the microwave oven. The lock section 12 has a first lock part 12*a*, link bar part 12*b* and a second lock part 12*c*. The first lock part 12*a* has a first hook engagement hole 12*aa* for accommodating a first hook of the microwave oven door in order for the first hook to be engaged with the first lock part 12*a*. The first lock part 12*a* performs electrical switching operations necessary for a normal microwave oven operation when the first hook is engaged with the first hook engagement hole 12*aa*. The second lock part 12*c* has a second hook engagement hole 12*cc* for accommodating a second hook of the microwave oven door in order for the second hook to be engaged with the second lock part 12*c*. The second lock part 12*c* performs electrical switching operations necessary for a normal microwave oven operation in association with the engagement of the first hook when the second hook is engaged with the second hook engagement hole 12*cc*. The link bar part 12*b* connects the first lock part 12*a* with the second lock part 12*c*. That is, one end of the link bar part 12*b* is connected with the bottom of the first lock part 12*a*, and the other end of the link bar part 12*b* is connected with the top of the second lock part 12*c*. In the door lock mechanism with a duct as shown in FIG. 2, the first lock part 12*a*, the link bar part 12*b* and the second lock part 12*c* may be formed in one body.

However, since the conventional door lock mechanism with a duct 10 has the first hook engagement hole 12*aa* and the second hook engagement hole 12*cc* with a distance fixed therebetween, the door lock mechanism with a duct 10 can be employed in a microwave oven having a door with the first and the second hooks having the same distance as that between the first and the second hook engagement holes 12*aa* and 12*cc*. That is, the door lock mechanism with a duct 10 with the distance between the first and the second hook engagement holes 12*aa* and 12*cc* fixed may be used only for a microwave oven of a certain size.

Therefore, since the door lock mechanism with a duct should be different according to different sizes, or heights in another point of view, of microwave ovens is different, the door lock mechanism with a duct should be newly manufactured whenever the size of a microwave oven is changed. In general, different sizes of microwave ovens have different distances between the first and the second door hooks.

SUMMARY OF THE INVENTION

It is an object of the present invention to provide a door lock mechanism with a duct capable for changing its height so as to be applied to different sizes of microwave ovens.

In order to attain the above object, the door lock mechanism with a duct according to the present invention comprises a duct section, a first lock part, a link bar part, a link bar part guiding part, a second lock part and an engagement part. That is, in a microwave oven having a door with a first hook and a second hook for opening and closing a cooking cavity and a door hook release button to be employed when opening the door, the duct section provides an air passageway for guiding air inside the microwave oven. The first lock part has a first hook engagement hole, and one end of the first lock part is fixedly connected with the bottom of the duct section. The first lock part performs a mechanical operations such as engagement with the first hook and electrical operations such as electrical switching for a normal microwave oven operation in association with the first hook and the door hook release button. The door hook release button is used for releasing the first hook from the engagement to open the door when the door is closed with engagement of the first hook with the first hook engagement hole. The link bar part is formed in a rectangular bar shape. One end of the link bar part is fixedly connected to the other end of the first lock part. One side of the link bar part has a plurality of engagement grooves, that is, a first engagement groove, a second engagement groove, and a third engagement groove in a column. The link bar part guiding part has a rectangular bar shape of which center portion is hollow to form an insertion groove. The upper portion of one side of the link bar part guiding part has an engagement hole. Further, the link bar part guiding part is long enough for the link bar part to be fully inserted thereinto. The second lock part has a second hook engagement hole for engaging the second hook. One end of the second lock part is fixedly connected with the bottom of the link bar part guiding part. Further, the second lock part performs a mechanical operations such as engagement with the second hook and electrical operations such as electrical switching for a normal microwave oven operation in association with the second hook and the door hook release button. The link bar part is inserted from the other end of the link bar part guiding part, the first, the second, and the third engagement grooves become correspondent to the engagement hole in turn when the link bar part is inserted into the insertion groove of the link bar part guiding part. The engagement part engages one of the plurality of engagement grooves with the engagement hole in order for the link bar part to be fixed to the link bar part guiding part.

The engagement enable the size, or the height in another aspect, of the door lock mechanism with a duct to be changeable so as to be applied to any microwave oven regardless of its size.

BRIEF DESCRIPTION OF THE DRAWINGS

These and other objects and features of the present invention can be understood through the following embodiment by reference to the accompanying drawing, in which.

DETAILED DESCRIPTION OF THE PREFERRED EMBODIMENT

Hereinafter, structure and operation of the door lock mechanism with a duct according to an embodiment of the present invention will be described in detail.

Figure 1:
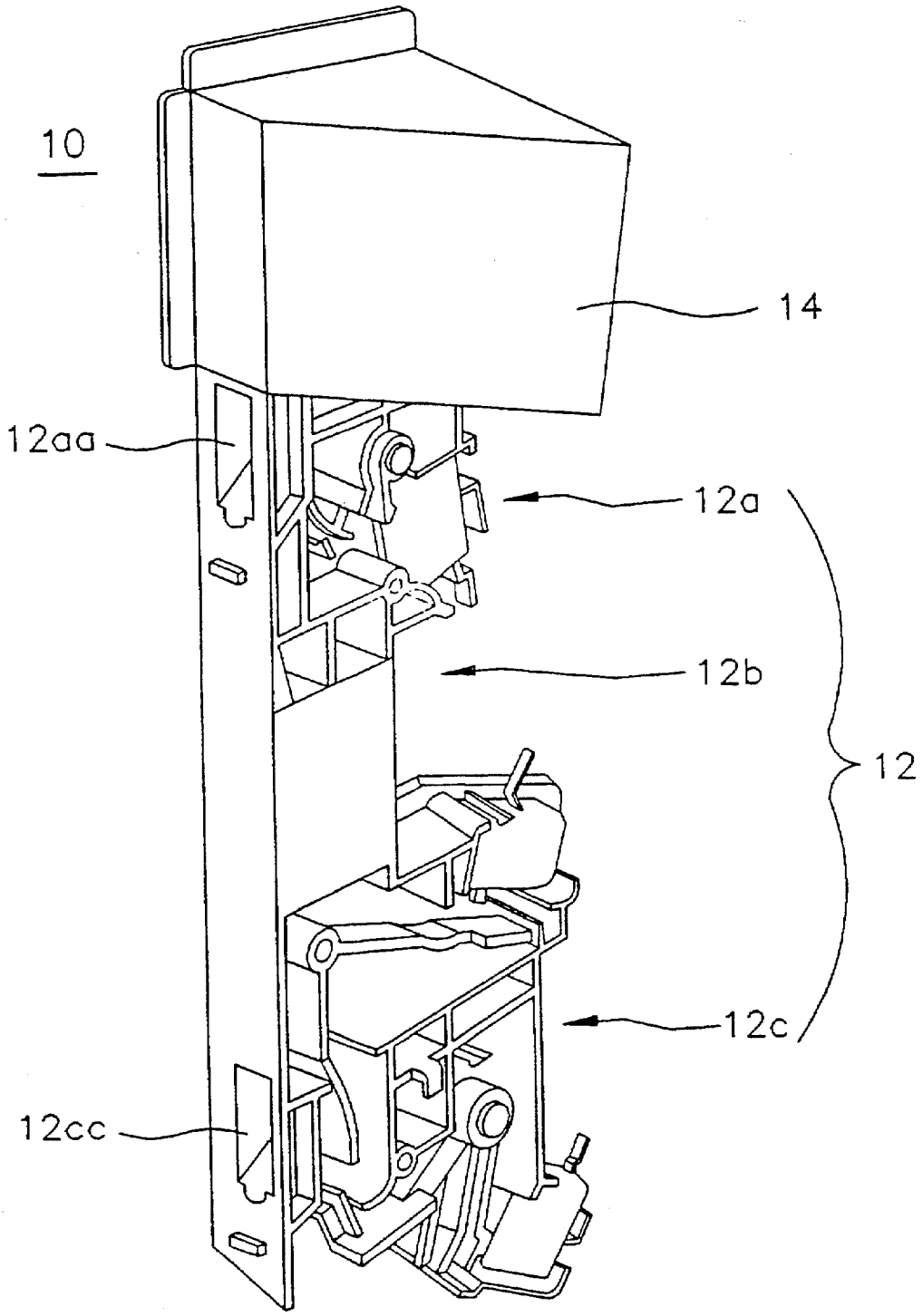
FIG. 1 PRIOR ART
FIG. 1 is a view for showing a conventional door lock mechanism with a duct for a microwave oven.
Figure 2:
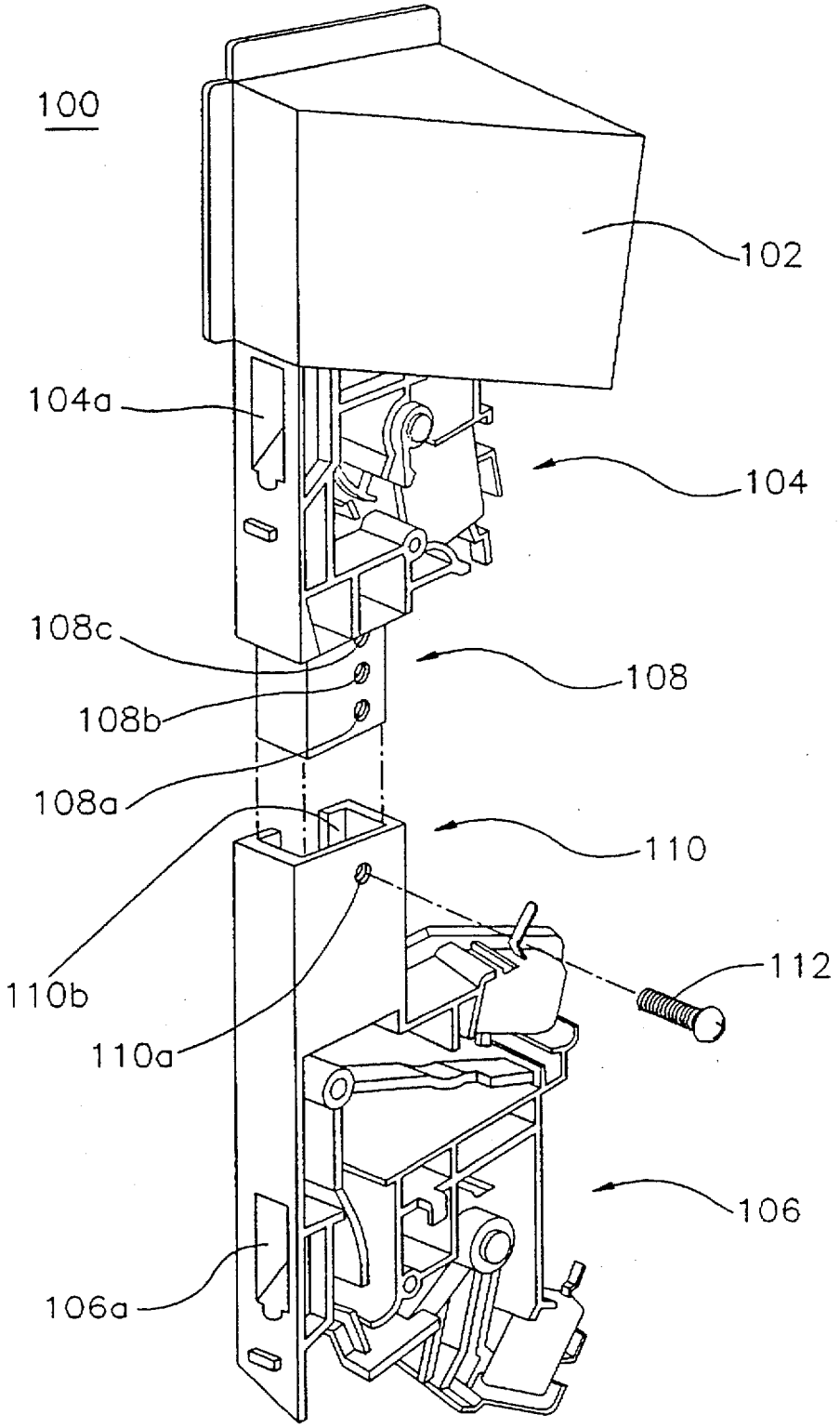
FIG. 2 is an exploded view for showing a door lock mechanism with a duct for a microwave oven according to an embodiment of the present invention.

FIG. 2 is an exploded view for showing a door lock mechanism with a duct for a microwave oven according to an embodiment of the present invention. General structure of a microwave oven such as door hooks, a door hook release button, etc., can be referred to the structure of the above-mentioned microwave oven, or to the structure of a general microwave oven. As shown in FIG. 2, the door lock mechanism with a duct 100 according to the embodiment of the present invention a duct section 102, a first lock part 104, a link bar part 108, a link bar part guiding part 110, a second lock part 106, and an engagement part 112.

The duct section 102 provides an air passageway for guiding air inside the microwave oven. The first lock part 104 has a first hook engagement hole 104*a*, and one end of the first lock part 104*a* is fixedly connected with the bottom of the duct section 102. The first lock part 104 performs a mechanical operations such as engagement with the first hook and electrical operations such as electrical switching for a normal microwave oven operation in association with the first hook and the door hook release button. The door hook release button is used for releasing the first hook from the engagement to open the door when the door is closed with engagement of the first hook with the first hook engagement hole 104*a*.

The link bar part 108 is formed in a rectangular bar shape. One end of the link bar part 108 is fixedly connected to the other end of the first lock part 104. One side of the link bar part 104 has a plurality of engagement grooves, that is, a first engagement groove 108*a*, a second engagement groove 108*b*, and a third engagement groove 108*c* in a column.

The link bar part guiding part 110 has a rectangular bar shape of which center portion is hollow to form an insertion groove 110*b*. The upper portion of one side of the link bar part guiding part 110 has an engagement hole 110*a*. Further, the link bar part guiding part 110 is long enough for the link bar part 108 to be fully inserted thereinto. The second lock part 106 has a second hook engagement hole 106*a* for engaging the second hook. One end of the second lock part 106 is fixedly connected with the bottom of the link bar part guiding part 110. Further, the second lock part 106 performs a mechanical operations such as engagement with the second hook and electrical operations such as electrical switching for a normal microwave oven operation in association with the second hook and the door hook release button. The link bar part 108 is inserted from the other end of the link bar part guiding part 110. The first, the second, and the third engagement grooves 108*a*, 108*b* and 108*c* become correspondent to the engagement hole 110*a* in turn when the link bar part 108 is inserted into the insertion groove 108 of the link bar part guiding part 110. The engagement part 112 engages one of the plurality of engagement grooves 108*a*, 108*b* and 108*c* with the engagement hole 110*a* in order for the link bar part 108 to be fixed to the link bar part guiding part 110.

The engagement part 112 fixedly engages the link bar part 108 with the link bar part guiding part 110. The engagement part 112 may be a screw.

Operations of the door lock mechanism with a duct 100 as mentioned above will be described in detail hereinafter.

Figure 3:
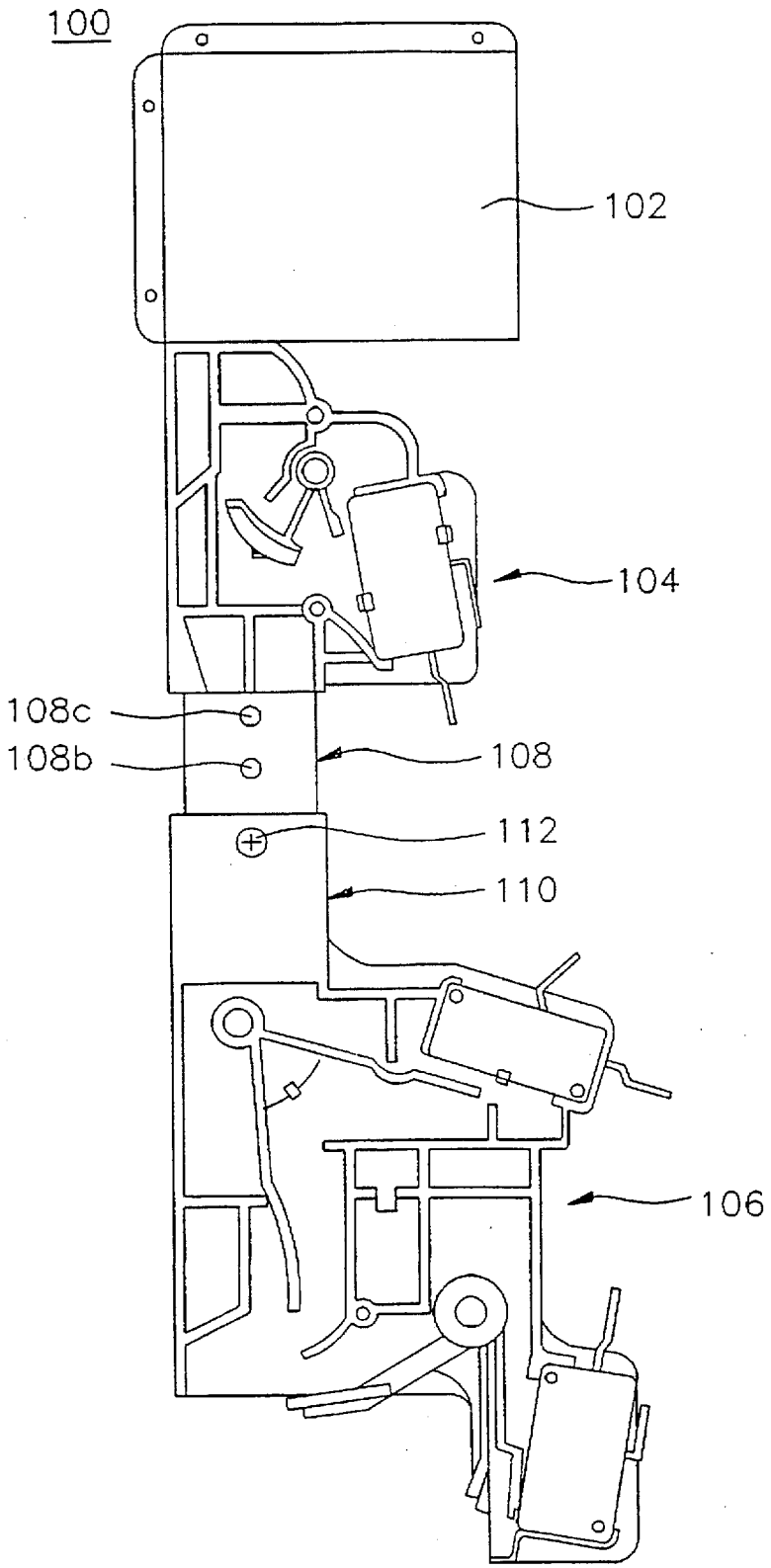
FIGS. 3 and 4 are views for explaining the operations of the door lock mechanism with a duct shown in FIG. 2.
Figure 4:
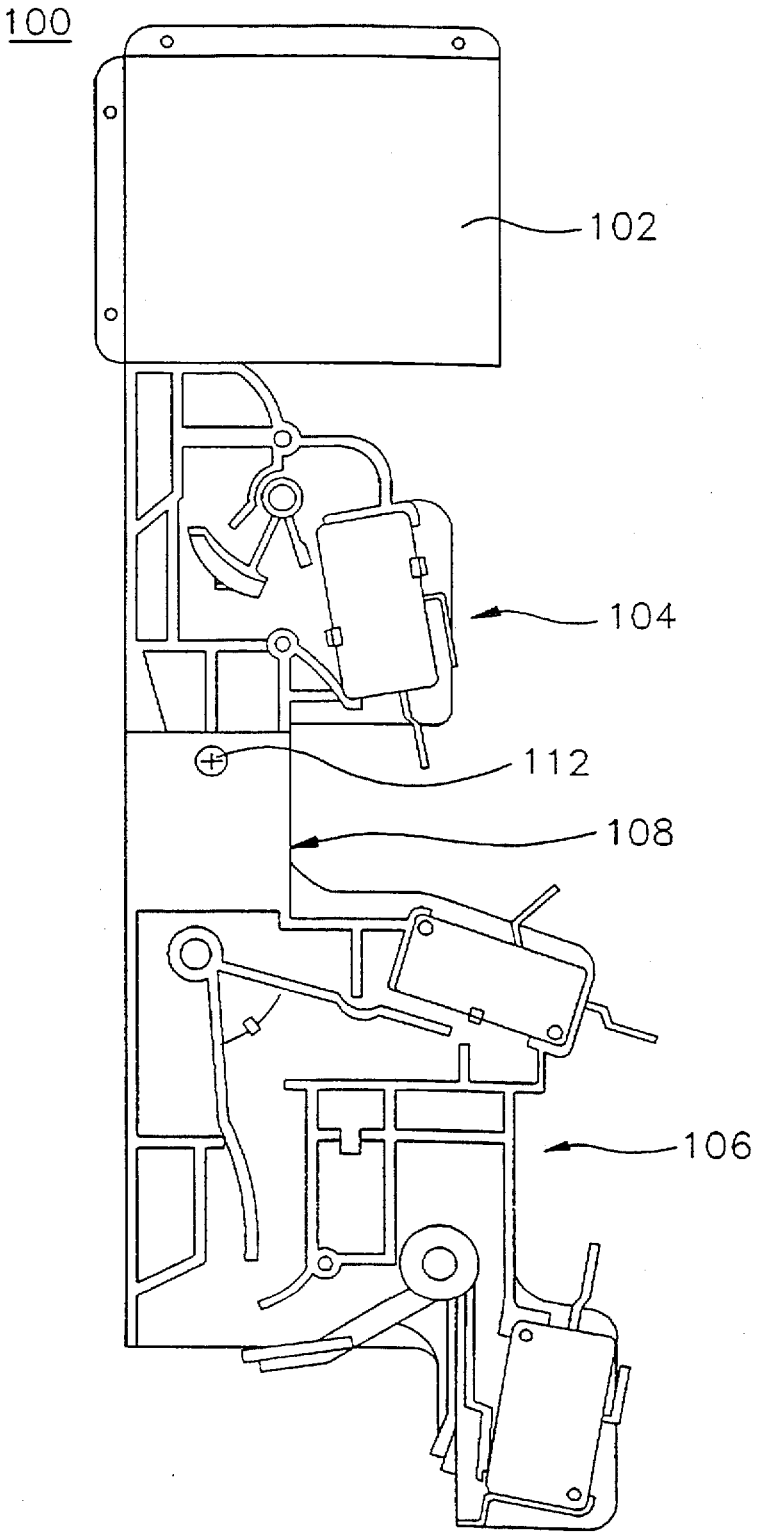

FIGS. 3 and 4 are views for explaining the operations of the door lock mechanism with a duct shown in FIG. 2. As can be seen from FIG. 2, the link bar part 108 is inserted into the link bar part guiding part 110. Further, FIG. 3 shows the state that the link bar part 108 is engaged with the link bar part guiding part 110 by the engagement part 112 when the first engagement groove 108*a* of the link bar part 108 is inserted to correspond with the engagement hole 110*a*. Such engagement sets the size, that is, height H1 of the door lock mechanism with a duct 100 to become highest. Accordingly, the door lock mechanism with a duct 100 has the biggest distance between the first hook engagement hole 104*a* and the second hook engagement hole 106*a*. The biggest distance between the first and the second hook engagement holes 104*a* and 106*a* enables the first and the second door hooks of a microwave oven having a big distance therebetween to be correspondingly inserted into the first and the second hook engagement holes 104*a* and 106*a*. In general, the size of a microwave oven becomes larger as a distance between the door hooks becomes bigger. Therefore, the door lock mechanism with a duct 100 according to the embodiment of the present invention, which is set as shown in FIG. 3, can be applied to a big size of a microwave oven.

FIG. 4 shows the state that the link bar part 108 is engaged with the link bar part guiding part 110 by the engagement part 112 when the third engagement groove 108*c* of the link bar part 108 is inserted to correspond with the engagement hole 110*a*. Such engagement sets the size, that is, height H2 of the door lock mechanism with a duct 100 to become least. Accordingly, the door lock mechanism with a duct 100 has the least distance between the first hook engagement hole 104*a* and the second hook engagement hole 106*a*. The least distance between the first and the second hook engagement holes 104*a* and 106*a* enables the first and the second door hooks of a microwave oven having a small distance therebetween to be correspondingly inserted into the first and the second hook engagement holes 104*a* and 106*a*. In general, the size of a microwave oven becomes smaller as a distance between the door hooks becomes smaller. Therefore, the door lock mechanism with a duct 100 according to the embodiment of the present invention, which is set as shown in FIG. 4, can be applied to a small size of a microwave oven. Here, the height H1 is bigger than the height H2.

It is understood that various other modifications will be apparent to and can be readily made by those skilled in the art without departing from the scope and spirit of this invention. Accordingly, it is not intended that the scope of the claims appended thereto be limited to the descriptions set forth herein, but rather that the claims be constructed as emcompassing all the features of the patentable novelty that reside in the present invention, including all the features that would be treated as equivalent thereof by those skilled in the art to which this pertains.

What is claimed is:

1. A door lock mechanism with a duct for performing mechanical operations for engagement with a first and a second door hooks and electrical operations for electrical switching for a normal microwave oven operation in association with the first and the second door hooks and a door hook release button, wherein the microwave oven has a door with the first and the second door hooks spaced away in a certain distance and the door hook release button for opening a cooking cavity, comprising:

a duct section for providing an air passageway for guiding air inside the microwave oven;

a first lock part having a first hook engagement hole, and for performing mechanical operations for engagement with the first hook and electrical operations for electrical switching for a normal microwave oven operation in association with the first door hook and the door hook release button, one end of the first lock part being fixedly connected with the bottom of the duct section;

the door hook release button for releasing the first door hook from the engagement to open the door when the door is closed with engagement of the first door hook with the first hook engagement hole;

a link bar part formed in a rectangular bar shape and having a plurality of engagement grooves, one end of the link bar part being fixedly connected to the other end of the first lock part;

a link bar guiding part formed in a rectangular bar shape of which center portion is hollow to form an insertion groove, the upper portion of the one side of the link bar part guiding part having an engagement hole, and the link bar part guiding part being long enough for the link bar part to be fully inserted thereinto, wherein the link bar part is inserted from the other end of the link bar part guiding part and each of the plurality of engagement grooves become correspondent to the engagement hole in turn when the link bar part is inserted into the insertion groove of the link bar part guiding part;

a second lock part having a second hook engagement hole for engaging the second door hook, and for performing mechanical operations for engagement with the second door hook and electrical operations for electrical switching for a normal microwave oven operation in association with the second door hook and the door hook release button, one end of the second lock part being fixedly connected with the bottom of the link bar part guiding part;

an engagement part for engaging one of the plurality of engagement grooves with the engagement hole in order for the link bar part to be fixed to the link bar part guiding part.

2. The door lock mechanism with a duct as claimed in claim 1, wherein the plurality of engagement grooves are three engagement holes in a column.

3. The door lock mechanism with a duct as claimed in claim 1, wherein the engagement part is a screw.

* * * * *